United States Patent [19]

Roberts

[11] 4,075,746

[45] Feb. 28, 1978

[54] COMPRESSION CRIMPING APPARATUS

[75] Inventor: John S. Roberts, Ellicott, Md.

[73] Assignee: Kling-Tecs, Inc., Columbia, Md.

[21] Appl. No.: 696,697

[22] Filed: Jun. 16, 1976

[51] Int. Cl.[2] ..... D02G 1/12

[52] U.S. Cl. ..... 28/264; 28/251

[58] Field of Search ..... 28/1.6, 1.7, 72.14, 28/251, 263, 264; 26/21

[56] References Cited

U.S. PATENT DOCUMENTS

| | | | |
|---|---|---|---|
| Re. 28,906 | 7/1976 | McKinney et al. | 28/1.7 |
| 36,005 | 7/1862 | Hunt et al. | 26/21 |
| 87,806 | 3/1869 | Waite | 26/21 |
| 2,107,476 | 2/1938 | Frusher, Jr. | 26/21 |
| 2,150,679 | 3/1939 | Frusher, Jr. | 26/21 |
| 3,110,076 | 11/1963 | Trifunovic et al. | 28/1.6 |
| 3,571,870 | 3/1971 | Dixon et al. | 28/72.14 |
| 3,587,145 | 6/1971 | McKinney et al. | 28/1.7 |
| 3,639,955 | 2/1972 | Fleissner et al. | 28/1.6 |
| 3,938,226 | 2/1976 | Roberts | 28/1.7 |

FOREIGN PATENT DOCUMENTS

| | | | |
|---|---|---|---|
| 47-40590 | 3/1972 | Japan | 28/263 |
| 6,610,253 | 8/1967 | Netherlands | 28/264 |
| 1,415,655 | 11/1975 | United Kingdom | 28/264 |

*Primary Examiner*—Robert R. Mackey
*Attorney, Agent, or Firm*—Nolte and Nolte

[57] ABSTRACT

Apparatus for compression crimping fibrous material, such as synthetic continuous filament yarn, is provided comprising means defining a compression crimping zone, means for feeding fibrous material into the compression crimping zone and a pair of movable members each having a face substantially opposed to a face of the other, said faces defining lateral walls of the zone and being biased toward each other to restrict egress of the fibrous material from the zone and thereby exert a back pressure on the fibrous material, causing the fibrous material to buckle, form a plug in the zone and thereby crimp in the zone, the aforementioned face of each of the members being laterally restricted by means rigidly connected to the member whereby the plug is prevented from escaping laterally from between the substantially opposed faces of the members. Preferably, the means laterally restricting the aforementioned face of each of the members is a pair of substantially parallel walls defining the side walls of a channel, the channel having a bottom defined by the face. Most preferably, the side walls are integral with the bottom of the channel, in other words, the channel is formed in the member.

3 Claims, 6 Drawing Figures

COMPRESSION CRIMPING APPARATUS

BACKGROUND OF THE INVENTION

This invention relates to apparatus for compression crimping fibrous material. More particularly, the invention relates to such apparatus having a pair of movable members, each of the members having a face substantially opposed to a face of the other, the faces defining lateral walls of the compression crimping zone of the apparatus and being biased toward each other to restrict egress of the fibrous material from the zone and thereby exert a back pressure on the fibrous material, causing the fibrous material to buckle, form a plug in the zone and thereby crimp in the zone.

Various apparatuses for compression crimping fibrous material can be provided which comprise means defining a compression crimping zone, means for feeding fibrous material into the compression crimping zone and a pair of movable members, commonly known as "pressure shoes," each having a face substantially opposed to a face of the other, the faces defining lateral walls of the zone and being biased toward each other to restrict egress of the fibrous material from the zone and thereby exert a back pressure on the fibrous material, causing the fibrous material to buckle, form a plug in the zone and thereby crimp in the zone. The shoes can be biased toward each other with a substantially constant force. Under the influence of the plug of yarn which is formed in the crimping zone, the shoes oscillate slightly. The apparatus can also include means defining a pair of opposed, stationary walls between which the shoes oscillate in planes parallel to the stationary walls. The stationary walls can abut the sides of the shoes in order to prevent the plug from escaping laterally from between the substantially opposed faces of the shoes. It is found that some of the filaments of the fibrous material of which the plug is constituted will now and then be caught between a shoe and one or the other of the aforementioned stationary walls. Undesired, uncontrolled tension is created in the plug and particularly in the filaments which have been caught, resulting in a lower degree of crimping. Moreover, the filaments which are caught may be damaged.

Another problem inherent in the arrangement of stationary walls abutting the shoes arises from the fact that a finish composition generally is applied to the fibrous material before the fibrous material is fed into the crimping apparatus. The finish composition lubricates the surfaces of the fibrous material and may also have anti-static properties, thereby facilitating the processing of the fibrous material. However, some of the finish composition, which rubs off the fibrous material, accumulates between the shoes and the abutting stationary walls. Similarly, pieces of broken filament and other debris accumulate between the shoes and the abutting stationary walls. This impedes oscillation of the shoes, which oscillation is essential in order that the shoes adjust to transient changes in the plug configuration or position thereby to provide substantially constant crimping conditions. One negative result, for example, is that, the effective pressure applied by the shoes may gradually decrease as the build-up of finish, pieces of broken filament and other debris between the shoes and the stationary walls decreases the force applied to the plug by the shoes.

It is an object of the present invention to provide an improvement in apparatus of the aforementioned type thereby to eliminate the problems described above.

Other objects and advantages of the invention will be apparent to one skilled in the art from the following description of the invention.

SUMMARY OF THE INVENTION

According to the invention, apparatus is provided for compression crimping fibrous material comprising means defining a compression crimping zone, means for feeding fibrous material into the compression crimping zone and a pair of movable members or "pressure shoes," each having a face substantially opposed to a face of the other, the faces defining lateral walls of the zone and being biased toward each other to restrict egress of the fibrous material from the zone and thereby exert a back pressure on the fibrous material, causing the fibrous material to buckle, form a plug in the zone and thereby crimp in the zone, the aforementioned face of each of the shoes being laterally restricted by means rigidly connected to the shoes whereby the plug is prevented from escaping laterally from between the substantially opposed faces of the shoes. Thus, filaments will not be caught between a shoe and an abutting stationary wall.

The abutting stationary walls of the prior art serve the function of maintaining the plug of fibrous material formed in the compression crimping zone between the shoes. In effect, in the present invention, walls performing the same function are integral with the shoes themselves. Because each shoe is a member discrete from the other shoe, the walls which are integral with the shoes do not completely enclose the plug of fibrous material. Nevertheless, these walls do keep the plug as a whole between the shoes. A filament or two or a few filaments may occasionally protrude laterally of the shoes through the spaces between the integral lateral walls of the respective shoes. For the purpose of the structural integrity of the head of the crimping machine, stationary lateral walls may be provided as in the prior art. However, as these walls are no longer necessary to maintain the plug as a whole between the shoes, the stationary lateral walls may be spaced from the shoes rather than abut the shoes as in the prior art. Consequently, the occasional protruding filaments which might still occur will not be caught between a shoe and a stationary wall. At the same time, there is sufficient space so that normal accumulations of finish, pieces of broken filament and other debris do not impede movement of the shoes.

In a preferred construction according to the invention, each pair of walls is provided simply by forming a channel in the respective shoe, such as my machining the channel if the shoe is steel or by molding the channel into the shoe if the shoe is molded from a plastic, the aforementioned face of the shoe, namely, the face which is opposed to a like face of the other shoe, defining the bottom of the channel.

DESCRIPTION OF A PREFERRED EMBODIMENT

The invention will now be further described by reference to a preferred embodiment, as illustrated in the drawings, in which.

Figures 1, 2, 3, 4:
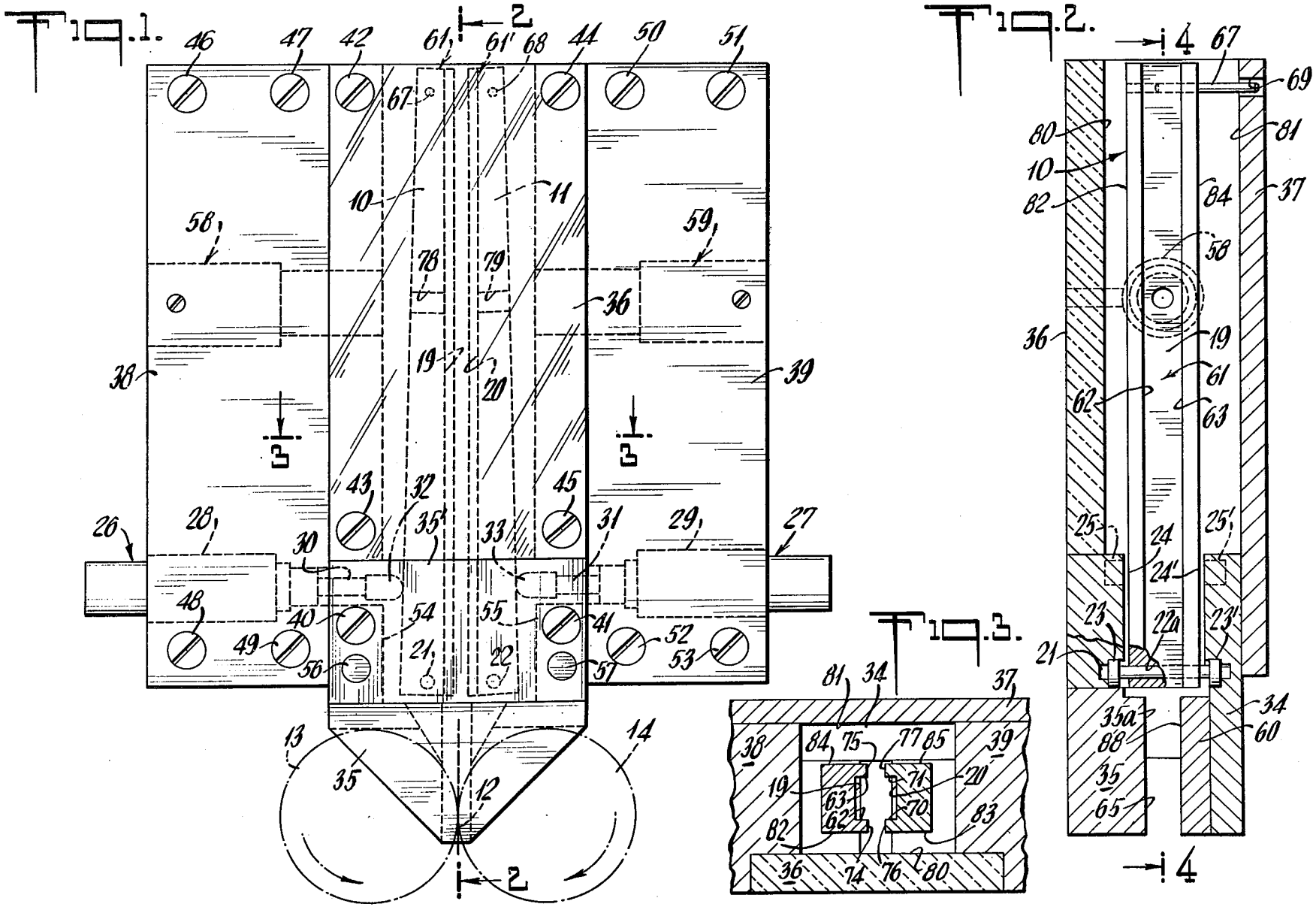
FIG. 1 is a front elevation of a compression crimping head embodying the improvement of the present invention.
FIG. 2 is a section taken along line 2—2 of FIG. 1.
FIG. 3 is a section taken along line 3—3 of FIG. 1.
FIG. 4 is a section taken along line 4—4 of FIG. 2.
Figure 4:
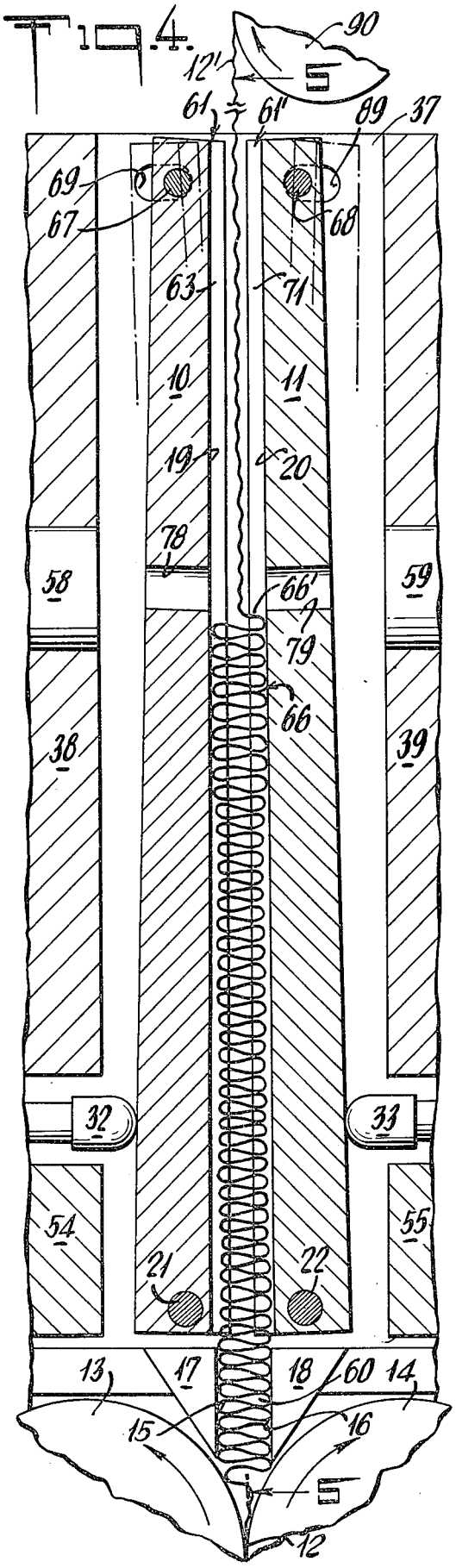

The portion of a crimping apparatus including the crimping zone is commonly referred to as a crimping head or a crimper head. In FIG. 1, a compression crimping head is illustrated in which members, more particularly pressure shoes, 10 and 11 define lateral walls of the zone. An uncrimped yarn 12 is fed into the crimping head by means of counter-rotating driven nip rollers 13 and 14, the directions of rotation of which are indicated by respective arrows in FIG. 1. The crimping zone has static lateral walls defined by opposed faces 15, 16 of respective side rails 17, 18 followed by dynamic lateral walls defined by opposed faces 19, 20 of pressure shoes 10, 11 (FIG. 4).

Figure 5:
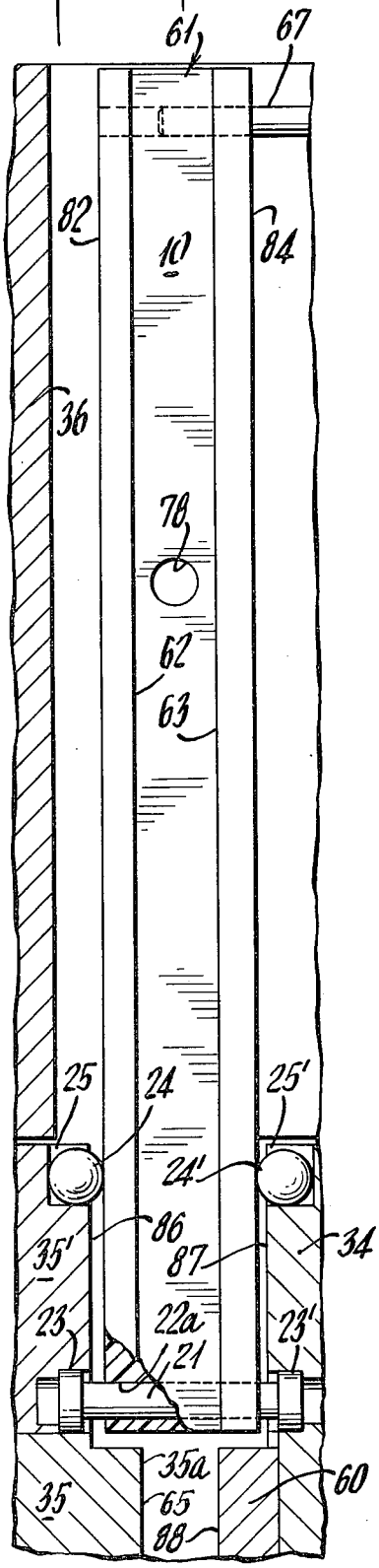
FIG. 5 is a section taken along line 5—5 of FIG. 4.

The faces 19 and 20 define dynamic walls of the compression crimping zone because the pressure shoes 10, 11 are mounted on respective pivot shafts 21, 22 which are supported in pairs of bearings 23, 23' (FIGS. 4 and 5). The pivotal movement of the shoes 10 and 11 is assisted by ball bearings 24, 24' which are arranged in recesses 25, 25' (FIG. 5).

The shoes 10, 11 are biased toward each other by respective pneumatic cylinder and piston assemblies 26, 27. The assemblies 26, 27 have respective cylinders 28, 29 and respective pistons 30, 31. The pistons 30, 31 are provided with respective end caps 32, 33, which bear against respective shoes 10, 11.

The shoes 10, 11 are contained, in effect, in a four-sided "box," the back of which is formed by crimper head base plate 34 and sub-base plate 37 extending thereabove, the front of which is formed by, recited from the bottom upwards, upper cover 35', and a transparent plastic window 36, which permits observation of the plug of yarn in the crimping zone, the left side of which is formed by block 38 and the right side of which is formed by block 39. The bearings 23, 23' for the bearing shaft 21 are mounted in respective recesses in the upper cover 35' and the base plate 34. The bearings for the other bearing shaft, which are not illustrated, are mounted in the same way. The upper cover 35' is held in place by screws 40, 41 as well as dowels 56 and 57 and the window 36 is held in place by screws 42 to 45, inclusive. The blocks 38 and 39 are mounted on the sub-base plate 37 adjacent respective shoes 10 and 11 by means of screws 46 to 53, inclusive. Adjacent the lower ends of the shoes 10 and 11 are respective spacers 54 and 55 which are held in place by screws 40 and 41 as well as dowels 56 and 57.

The foregoing is all, of course, suitably supported on a machine.

The blocks 38 and 39 not only support the pneumatic cylinder and piston assemblies 26 and 27 but also support a light source 58 and a photoelectric cell 59 for receiving light from the light source 58.

The side rails 17 and 18 and a center rail 60 are mounted on the base plate 35 (FIG. 4). The rail 60 fits snugly part way between the opposed faces 15 and 16 of the side rails 17 and 18. The lower cover 35 is formed with a protrusion 35a.

Figure 6:
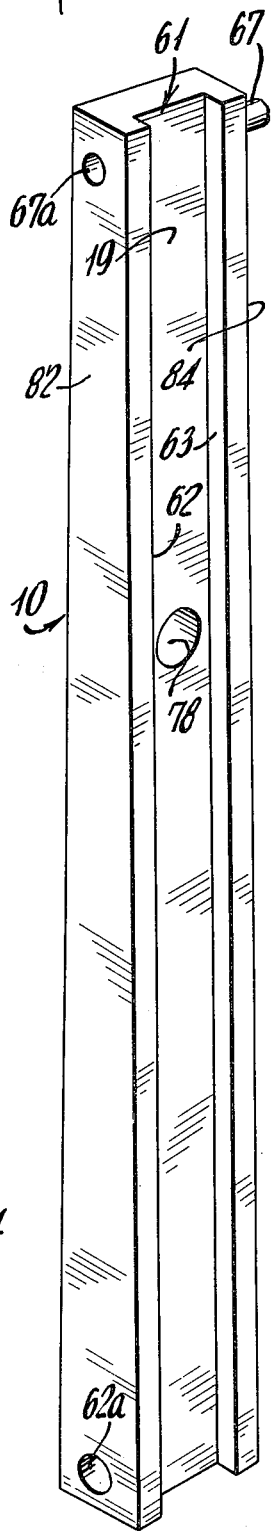
FIG. 6 is an isometric view of one of the pressure shoes of the invention.

In each of the shoes a channel 61, 61' is formed. The base of each channel 61, 61' constitutes the face 19 or 20 of the shoe which is opposed to a like face of the other shoe and the side walls 62, 63 and 70, 71 of the channels comprise pairs of substantially parallel walls which constitute means laterally restricting the aforementioned faces of the shoes (FIGS. 5 and 6). Through the lower end of each shoe, on an axis normal to the walls 62, 63 or 70, 71 is provided a bore **22*a* in which the pivot shaft 21 or 22 is press fit. Near the other extremity of each shoe is provided a like bore 67*a* of smaller diameter in which a pin 67 or 68** is press fit.

Regarding the operation of the apparatus, an uncrimped yarn 12 is advanced by means of the nip rollers 13 and 14 into a channel of approximately square cross-section one pair of opposed walls of which is defined by the respective faces 15 and 16 of the side rails 17 and 18 and the other pair of opposed walls of which is defined by the respective faces 65 of protrusion **35*a* and 88 of center rail 60 (FIGS. 2, 4 and 5). This is the static part of the crimping zone. From there the yarn advances into the dynamic portion of the crimping zone, that is the portion defined by the channels 61 and 61' in the respective shoes 10 and 11**.

A plug of yarn 66 is formed in the crimping zone. The resulting crimped yarn 12' is taken up on a driven take-up package 90. The formation of the plug 66 is due to a combination of the feed speed being greater than the take-up speed and the fact that egress of the yarn is restricted by the shoes 10 and 11, which is all well known. The restriction of the egress of the yarn takes place in normal operation by contact of the opposed faces 19 and 20 of the shoes 10 and 11 and the opposed side walls 62, 63 and 70, 71 of the channels formed in the shoes with the plug 66 at a portion of the plug 66 including part of the leading end 66' thereof as well as immediately subjacent portions of the plug. It is seen that the spacing between the opposed faces 15 and 16 of the respective rails 17 and 18 is slightly less than the spacing between the opposed faces 19 and 20 of the shoes 10 and 11 at the bottom of the shoes 10 and 11, and the spacing between the face 65 of the protrusion **35*a* and the opposed face 88 of the center rail 60 is slightly less than the spacing between opposed side walls 62, 63 and 70, 71 of the channels formed in the shoes 10 and 11 at the bottom of the shoes 10 and 11. After the cross-section of the plug 66 is initially defined by the spacing between the faces 15 and 16 and the faces 65 and 88, the plug 66 essentially holds this cross-section and, hence, is out of contact with the faces 19, 20 and the channel walls 62, 63 and 70, 71 until the slight inward inclination imparted to the shoes 10 and 11 and, consequently, to the faces 19 and 20 by the action of the cylinder and piston assemblies 26 and 27 on the shoes 10 and 11 causes the faces 19 and 20 to contact the plug 66 at the aforementioned portions and slightly compress the plug 66, thereby restricting egress of the yarn. As is well known by those skilled in the art, it is this restriction which exerts a back pressure against the forwarding of the yarn by the nip rollers 13 and 14, hence causing the yarn to buckle, form a plug and thereby crimp. Naturally, this slight compression of the plug 66 will also cause adjacent portions of the plug 66 on the other sides of the plug 66 to contact the side walls 62, 63 and 70, 71 of the channels in the shoes 10 and 11**, which, therefore, also incidentally contributes slightly to the restriction of the upwards egress of the yarn.

The pressure with which the pistons 30 and 31 act against the shoes 10 and 11 is adjusted so that the normal, steady-state operation of the apparatus is as illustrated in FIG. 4. It will be understood that, of course, some oscillation of the pistons and shoes will occur during normal operation as the pistons maintain a substantially constant pressure on the shoes. Respective pins 67 and 68 are provided near the upper extremity of the shoes 10 and 11. The pins 67 and 68 ride in slots 69 and 89, respectively, formed through the sub-base plate 37. The inner extremities of the slots 69 and 89 serve to prevent the shoulders 74, 75, 76 and 77 (FIG. 3) adjoining the channel side walls 62, 63, 70, and 71, respectively, from meeting and thereby, perhaps pinching a stray filament of the plug 66. The outer extremities of the slots 69 and 89 prevent the shoes 10 and 11 from possibly skewing outwards to an extreme in the event of cut-off of the pneumatic pressure to the cylinders 28 and 29.

Respective bores 78 and 79 are formed through the shoes 10 and 11 to permit the passage of light from the light source 58 to the photoelectric cell 59. To assure that the leading end 66' of the plug 66 does not retreat downwards, where no means are provided for sensing the position of the leading end of the plug, the apparatus is operated at relative feed and withdrawal rates such that the leading end 66' of the plug 66 tends gradually to move upward. When the plug 66 has moved upward sufficiently so that the light is completely blocked, a relay in conventional circuitry is actuated to speed up the motor driving the take-up package 90 until the photoelectric cell 59 again receives light from the light source 58. It may be desirable to provide conventional means for effecting a slight time delay so that momentary blocking of the light is not sufficient to speed up the take-up whereby the apparatus does not respond to a very transient condition, response being unnecessary.

The opposed side walls 62, 63 and 70, 71 of the channels 61 and 61', respectively, in the shoes 10 and 11 keep the plug 66 from escaping laterally from between the respective faces 19 and 20 of the shoes 10 and 11. The inner face 80 of the window 36 and the inner face 81 of the sub-base plate 37 are substantially spaced from the shoes 10 and 11 so that any random filaments of the plug 66 escaping through the space between the shoulders 75 and 77 or the space between the shoulders 74 and 76 cannot be pinched between the lateral exterior faces 82, 83 of the shoes 10, 11, respectively, and the face 80 of the window 36 or between the lateral exterior faces 84, 85 of the shoes 10, 11, respectively, and the face 81 of the sub-base plate 37. At the lower portion of the shoes 10, 11 where the inner face 86 of the upper cover 35' and the inner face 87 of the base plate 34 are somewhat closer to the shoes, there is no tendency for filaments to be pinched between the lateral exterior faces of the shoes and the faces 86 and 87 because the spacing is still too great for that to occur. The aforementioned substantial spacings between the lateral exterior faces of the shoes and faces of fixed portions of the apparatus opposed thereto offers a further advantage, namely, accumulations of broken pieces of filament, yarn finish and the like in these spaces will exert no friction on the shoes due to the substantial clearances afforded by these spaces. The lateral exterior faces of the shoes are contacted only by the bearings 24 and 24', resulting in very minimal friction. Because oscillation of the shoes is so unimpeded, operation of the apparatus with reliable, substantially constant pressure contact of the shoes with the plug is assured.

Apparatus of the type to which the present invention relates is applicable to the crimping of yarns, threads, tows, and the like. These are referred to generically herein as "fibrous material."

While the invention has been described herein particularly with reference to a preferred embodiment, it is to be understood that the scope of the invention, as defined by the appended claims, is intended to include all modifications and variations thereof which would be obvious to one of ordinary skill in the art.

What I claim is:

1. Apparatus for compression crimping filamentary yarn comprising means defining a compression crimping zone, means for feeding filamentary yarn into the compression crimping zone, a pair of movable members each having a face substantially opposed to a face of the other, said faces defining lateral walls of the zone, means for positively biasing said members toward each other to restrict egress of the yarn from the zone and thereby constituting said members as means for exerting a back pressure on the yarn, causing the yarn to buckle, form a plug in the zone and thereby crimp in the zone, opposing surface means downstream of said feeding means and upstream of said movable members for initially guiding and establishing the lateral cross-sectional dimension of the plug, said members extending downstream from the downstream ends of said opposing surfaces for substantially the length of said zone, each said face of each of the members being restricted by opposing wall means extending from the member for preventing filaments of the plug from escaping from between the members.

2. An apparatus according to claim 1, further comprising means defining a pair of opposed, stationary walls, said members being mounted for movement in planes parallel to said stationary walls, and in which said stationary walls are spaced from the sides of said members whereby any filaments from the plug which become located laterally displaced from the members cannot become caught between the members and the stationary walls.

3. The apparatus of claim 1 wherein each of the members comprises a channel formed therein, each of the channels having a pair of substantially parallel walls comprising said opposing wall means and defining the sides of the channel and a flat bottom substantially facing the bottom of the other member said bottoms comprising said faces and defining the lateral walls of the zone.

* * * * *